US010434364B2

(12) United States Patent
Cristofori et al.

(10) Patent No.: US 10,434,364 B2
(45) Date of Patent: Oct. 8, 2019

(54) SUPPORT FRAME FOR A GYMNASTIC APPARATUS, PARTICULARLY FOR A CYCLING SIMULATION DEVICE

(71) Applicant: TECHNOGYM S.P.A., Cesena (IT)

(72) Inventors: Claudio Cristofori, Cesena (IT); Marco Lorusso, Cesena (IT); Roberto Gorza, Cesena (IT)

(73) Assignee: TECHNOGYM S.P.A., Cesena (IT)

( * ) Notice: Subject to any disclaimer, the term of this patent is extended or adjusted under 35 U.S.C. 154(b) by 176 days.

(21) Appl. No.: 15/631,587

(22) Filed: Jun. 23, 2017

(65) Prior Publication Data

US 2018/0001136 A1 Jan. 4, 2018

(30) Foreign Application Priority Data

Jul. 1, 2016 (IT) ..... 102016000068777

(51) Int. Cl.

| | |
|---|---|
| ***A63B 22/06*** | (2006.01) |
| ***A63B 22/00*** | (2006.01) |
| ***A63B 69/16*** | (2006.01) |
| *A63B 21/015* | (2006.01) |

(Continued)

(52) U.S. Cl.

CPC ..... *A63B 22/0605* (2013.01); *A63B 22/0087* (2013.01); *A63B 69/16* (2013.01); *A63B 21/00069* (2013.01); *A63B 21/015* (2013.01); *A63B 21/22* (2013.01); *A63B 21/225* (2013.01); *A63B 22/06* (2013.01); *A63B 2069/165* (2013.01)

(58) Field of Classification Search

CPC ..... A63B 21/00069; A63B 21/015; A63B 21/225; A63B 21/22; A63B 21/00047; A63B 22/0605; A63B 22/0087; A63B 22/06; A63B 69/16; A63B 2069/165; A63B 2069/161; A63B 2069/162; A63B 2069/163; A63B 2069/166

See application file for complete search history.

(56) References Cited

U.S. PATENT DOCUMENTS

| | | | | |
|---|---|---|---|---|
| 1,621,120 | A * | 3/1927 | Lee | A63B 69/16 482/61 |
| 3,259,385 | A | 7/1966 | Boren | |
| 4,390,177 | A | 6/1983 | Biran et al. | |

(Continued)

OTHER PUBLICATIONS

Search Report dated Apr. 18, 2017, and Written Opinion for corresponding Italian Patent Application No. 102016000068777.

*Primary Examiner* — Megan Anderson

(74) *Attorney, Agent, or Firm* — Morgan, Lewis & Bockius LLP

(57) ABSTRACT

The present invention concerns a support frame for a gymnastic apparatus, particularly for a cycling simulation device, comprising a base, and a first arm hinged with said base and a second arm hinged with said base, so that said first and second arm can assume a closed position and an open position, rotating with respect to said base, characterized in that said support frame comprises an articulation member articulated with said base and said first and second arm such that the rotation of one of said first or second arm relatively to said base causes a rotational translation of said articulation member and the rotation of the other arm with respect to said base, causing the passage from said closed position to said open position or vice versa.

17 Claims, 6 Drawing Sheets

(51) Int. Cl.
*A63B 21/22* (2006.01)
*A63B 21/00* (2006.01)

(56) References Cited

U.S. PATENT DOCUMENTS

| | | | | |
|---|---|---|---|---|
| 5,480,366 | A | 1/1996 | Hamden et al. | |
| 6,780,143 | B2 * | 8/2004 | Copeland | A63B 69/16 482/61 |
| 9,999,818 | B2 * | 6/2018 | Hawkins, III | A63B 24/0087 |
| 2008/0200308 | A1 * | 8/2008 | Pedrini | A61B 5/0205 482/6 |
| 2009/0029832 | A1 * | 1/2009 | Sartore | A63B 21/0051 482/63 |
| 2014/0171272 | A1 | 6/2014 | Hawkins, III et al. | |
| 2015/0051054 | A1 | 2/2015 | Barnhill | |

* cited by examiner

SUPPORT FRAME FOR A GYMNASTIC APPARATUS, PARTICULARLY FOR A CYCLING SIMULATION DEVICE

The present invention relates to a support frame for a gymnastic apparatus, particularly for a cycling simulation device.

More specifically, the invention concerns a support frame of the mentioned type, studied and realized particularly for sport activity simulating machines of a user, for example, his own bicycle, even in closed spaces.

In the following, the description will be directed to the use for a cycling simulation device, but it is clear that the same should not be considered limited to this specific use.

As is well known, cycling simulation devices are currently commercially available, also known as cyclosimulators or cyclo-ergometers, which allow a user to perform stationary cycling workouts, therefore even in closed environments or in limited spaces, even using their own bicycle.

These devices are suitable for simulating pedaling with any bicycle, e.g. by road bikes, mountain bikes and the like.

Generally, a cycling simulation device comprises a support frame and a mechanical unit, for the simulation of the workout, installed on said support frame.

Said support frame generally comprises a main support member, a base, to which said main support member is fixed, and two arms, hinged to said base and capable of assuming a close position, in which they are substantially arranged in parallel, and an open position, in which they are spaced apart with respect to said central support member, so as to support the device.

Said mechanical unit is installed in particular on said main support member and includes mechanical members for simulating the pedaling resistance of a wheel.

In particular, said mechanical unit comprises a sprocket set keyed on a shaft, a pulley, also keyed on said shaft, a flywheel, connected by means of suitable transmission means to said pulley, and braking members acting on said flywheel.

To normally use a cycling simulation device according to the prior art, a user releases the rear wheel of his bicycle, and engages the bicycle traction members, i.e. the chain, with said sprocket set. In this way, pedaling on the pedals of his bicycle, the user moves the flywheel, which simulates the pedaling resistance of a wheel, and performs the cycling workout. By means of the braking members it is possible to adjust the effort to perform and therefore the intensity of the training.

A technical problem of the cycling simulation devices according to the prior art concerns the fact that they are all particularly uncomfortable in their opening and closing.

In particular, said devices are generally employed at home or in gyms or training centers and should therefore often be moved. This means that they have to be continuously closed and opened.

In some prior art documents devices are also described in which the arms are individually opened, that is, the user must first open one arm and then the other and to keep them in open position and prevent imbalances that can be risky for the user (who may also fall off the bicycle), it is necessary to secure them with pins.

Consequently, in order to close said arms, manually removing said pins is necessary, closing the arms, and moving the cycling simulation device.

To subsequently open the arms, manually widening individually the arms is needed, paying attention to their correct opening and inserting the pins into the respective holes to fix said arms.

It is obvious that this procedure is burdensome in terms of security and installation time of the cycling simulation device.

In the light of the above, it is an object of the present invention to propose a support frame for a cycling simulation device or a gymnastics machine generally capable of opening the arms in an automatic and safe way, also allowing a quick closing.

Another object of the present invention is to provide a support frame, which can be opened by acting on only one of the two arms.

It is therefore specific object of the present invention a support frame for a gymnastic apparatus, particularly for a cycling simulation device, comprising a base, and a first arm hinged with said base and a second arm hinged with said base, so that said first and second arm can assume a closed position and an open position, rotating with respect to said base, characterized in that said support frame comprises an articulation member articulated with said base and said first and second arm such that the rotation of one of said first or second arm relatively to said base causes a rotational translation of said articulation member and the rotation of the other arm with respect to said base, causing the passage from said closed position to said open position or vice versa.

Always according to the invention, said articulation member could be a connecting rod.

Still according to the invention, said connecting rod could have a first actuator arm, pivoted to said first arm, and a second actuator arm, pivoted to said second arm.

Advantageously according to the invention, said connecting rod could comprise a hook and said frame could comprise an opening spring, hooked to said hook and said support frame or to said base or to an anchoring pin of said base, said opening spring accumulating potential energy when said support frame is in the closed position, and releasing said potential energy by facilitating the rotational translation of said connecting rod.

Further according to the invention, said first and said second arm could have a respective end stop surface, said first and second arm open until said first actuator arm and said second actuator arm of said articulation member arrive in proximity respectively of said end stop surface of said first arm and said end stop surface of said second arm.

Always according to the invention, said articulation member, said base and said first and second arm could be articulated so as to allow the greater opening of one of said arms relative to each other.

Still according to the invention, said frame could comprise an opening and closing unit interacting with said articulation member, so as to lock it in position when said first and second arm take said closing and opening positions.

Advantageously according to the invention, said opening and closing unit could comprise a button, a lever, pivoted on said base by means of a respective pin, having a first end, on which said button can interact due to a solicitation, and a second end, an opening and closing pin, pivoted to said second end of said lever, said opening and closing pin being able to assume a working position and a rest position, a contrast spring arranged so as to exert a force to hold said opening and closing pin in said working position, and in that said articulation member has a first cavity and a second cavity, with which said opening and closing pin is inserted or interferes when it is in said working position, respectively in said closed and open position of said first and second arm.

Further according to the invention, said base could have a seat, said opening and closing pin could be slidably movable in said seat, and said contrast spring is interposed between said seat and said opening and closing pin.

Always according to the invention, said frame could comprise an elastic element, arranged between said button and said first end of said lever, said elastic element being adapted to compensate mechanical backlashes.

Still according to the invention, said elastic element could be a spring or a plate made of harmonic steel.

Advantageously according to the invention, said frame could comprise a main support member integral with said base, on which a mechanical unit is installed for the execution or simulation of a gymnastic exercise, such as a cycling simulation device.

It is further object of the present invention a cycling simulation device comprising a support frame as defined above and a mechanical unit for the execution or the simulation of the gymnastic exercise, installed on said support frame, comprising a sprocket set keyed on a shaft, a pulley keyed on said shaft, a flywheel, connected by transmission members to said pulley, such as a belt and the like, and braking members acting on said flywheel.

The present invention will be now described, for illustrative but not limitative purposes, according to its preferred embodiments, with particular reference to the figures of the enclosed drawings, wherein.

In the various figures, similar parts will be indicated by the same reference numbers.

Figure 1:
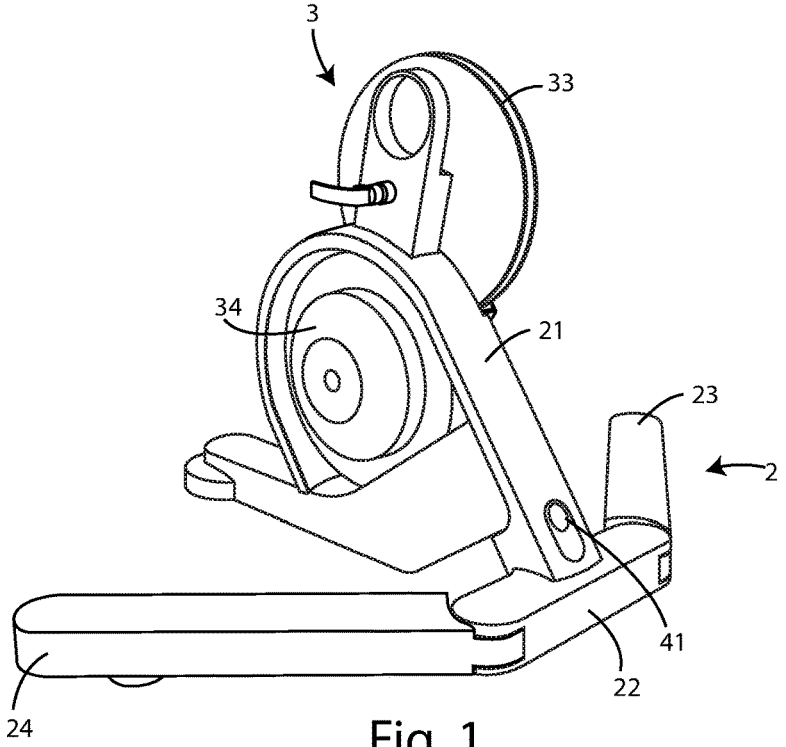
FIG. 1 shows a first perspective view of a cycling simulation device provided with the support frame according to the present invention in an open position.

Referring to FIGS. 1-10, a cycling simulation device 1 is observed provided with a support frame 2 according to the present invention.

The cycling simulation device 1 essentially comprises said support frame 2, a mechanical unit 3 for performing or simulating gym workout, an opening and closing unit 4, and an actuating unit 5 for opening and closing said support frame 2.

In more detail, the support frame 2 comprises a main support member 21 and a base 22, which said main support member 21 is fixed to. Said base 22 has an anchoring pin 222, which function will be better described below.

Figure 2:
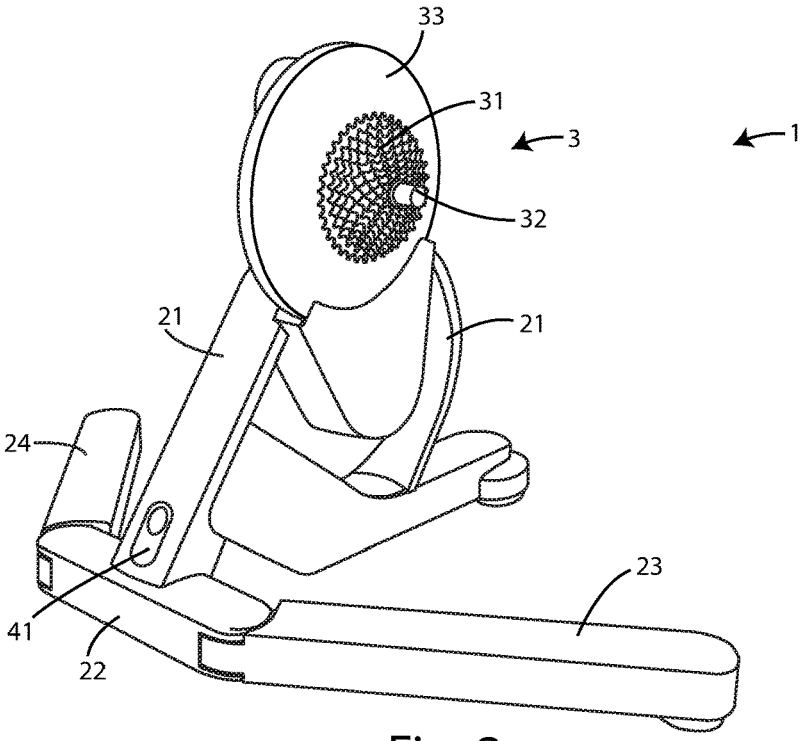
FIG. 2 shows a second perspective view of the cycling simulation device according to FIG. 1.
Figure 3:
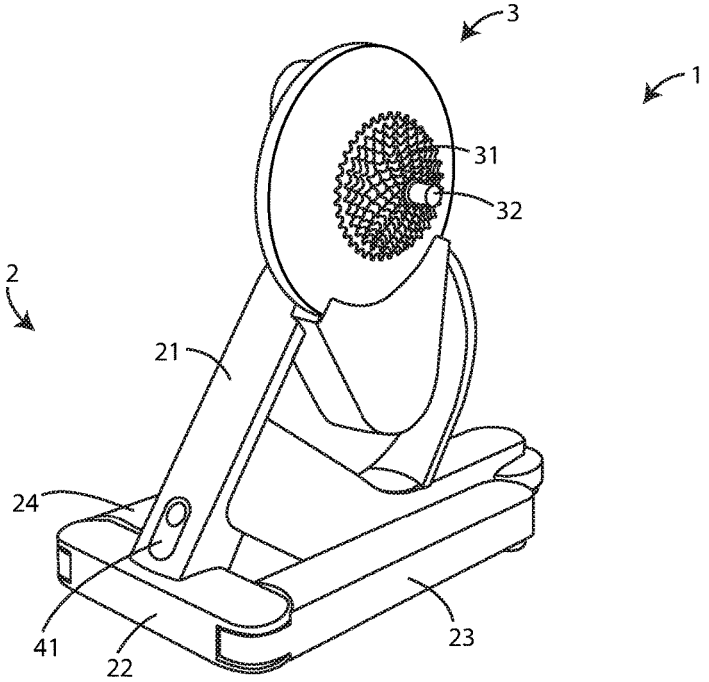
FIG. 3 shows a first perspective view of the cycling simulation device provided with the support frame according to FIG. 1 in a closed position.
Figure 4:
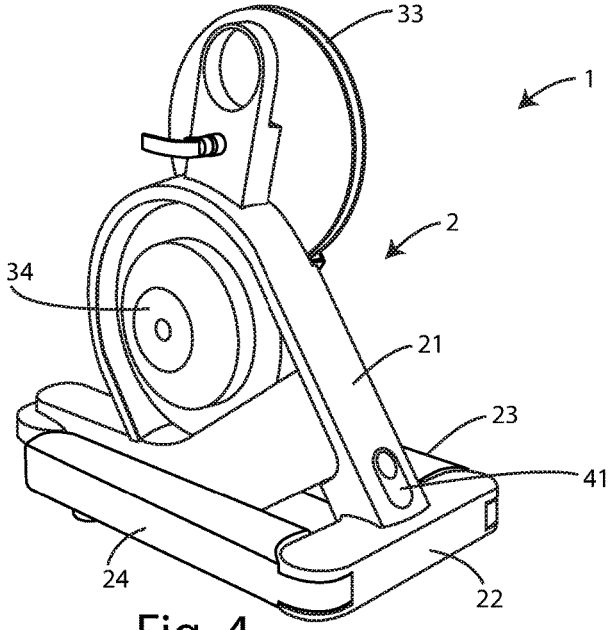
FIG. 4 shows a second perspective view of the cycling simulation device according to FIG. 3.
Figure 5:
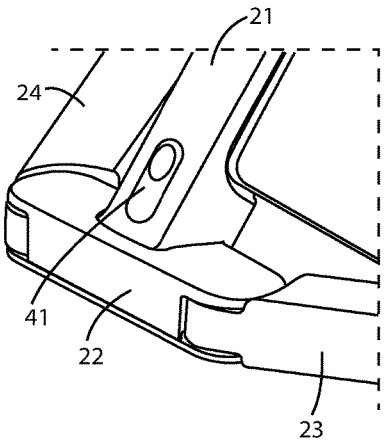
FIG. 5 shows a perspective view of a detail of the support frame according to the present invention.
Figure 6:
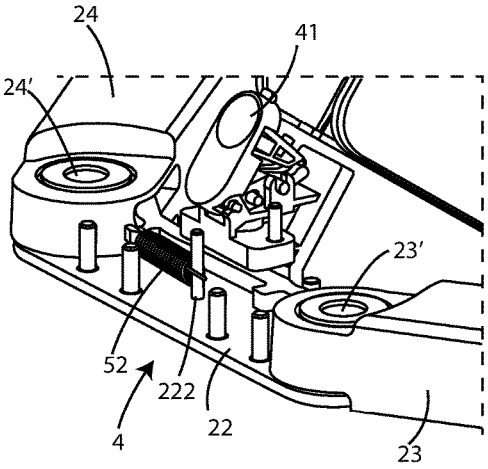
FIG. 6 shows the opening and closing system of the support frame according to the present invention.
Figure 7:
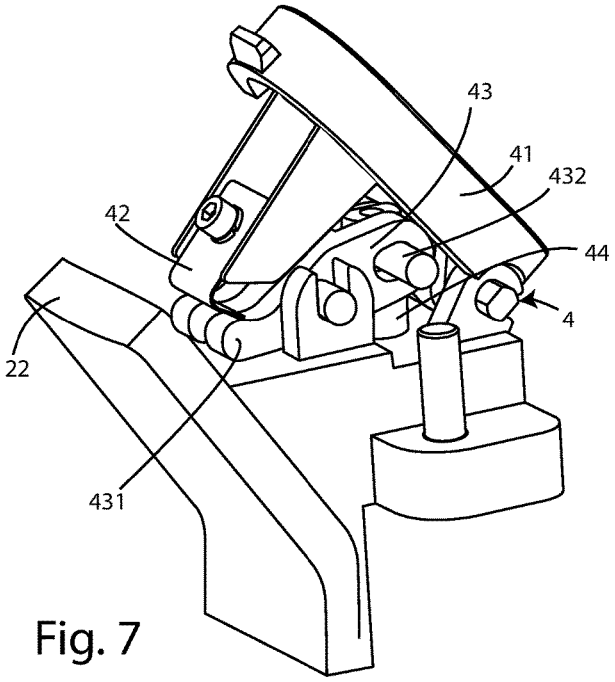
FIG. 7 is a perspective view of a part of the opening and closing system of the support frame of the cycling simulation device according to the present invention.

Moreover, said support frame 2 also comprises a first 23 and a second 24 arm, both pivoted about said base 22 by means of respective pins 23' and 24', and can assume a closure position, in which they are substantially parallel arranged or in close proximity to said central support member 21, as shown in particular in FIGS. 3 and 4, and an opening position, in which they are spaced or spaced from said central support member 21 and said base 22, as shown in particular in the FIGS. 1 and 2, so as to support the cycling simulation device 1.

It is seen that said first 23 and said second 24 arm have a respective end stop surface 231 and 241, as shown in particular in FIG. 10, which operation will be better described below.

Said base 22 and said first 23 and second 24 arm form, as it is seen, the support plane of the cycling simulation device 1.

Said mechanical simulation unit 3 is fixed to said main support member 21 and includes a sprocket set 31 keyed on a shaft 32, a pulley 33 also keyed on said shaft 32, and a flywheel (not shown in the figure) connected with said pulley by means of suitable transmission means, such as a belt and the like.

Said mechanical simulation unit 3 also includes braking members acting on said flywheel (not shown). In the figures the carter 34 is shown, which protects said flywheel.

The opening and closing unit 4 comprises a button 41, pivoted about a pin 411 to said base 22 of said frame 2, and an elastic member 42, such as a compensation spring, which, in the shown embodiment, is a plate made of harmonic steel, capable of compensating mechanical plays between the different elements of said opening and closing unit 4, which operation will be better explained below.

Said opening and closing unit 4 also includes a lever 43, which is pivoted into its central part to said base 22 by means of a pin 430, having a first end 431, on which said button 41 may act by means of said plate 42, and a second end 432, pivoted about an opening and closing pin 44, slidably movable in a seat 221, formed in said base 22 of said frame 2.

Said opening and closing pin 44 is capable of assuming a working position, in which it is lowered with respect to said base 22, and a rest position, in which it is raised or retracted with respect to said base 22.

Between said opening and closing pin 44 and the inner surface of said seat 221 a contrast spring 441 is provided, which function will be better defined in the following.

The actuating unit 5 comprises a rod, in particular a connecting rod 51 having a hook 512, a first actuating arm 513, pivoted about a respective pin 513' to said first arm 23, and a second actuating arm 514, pivoted about a respective pin 514', to said second arm 24.

Said connecting rod 51, said base 22 and said first 23 and second 24 arm, provide an articulated system, such that the movement by the user of one of said first 23 and second 24 arm also causes the other arm to move accordingly due to the roto-translation of said connecting rod 51, with respect to said base 22, which joins said first 23 and second 24 arm.

Said first arm 23, second arm 24 and connecting rod 51 all move with respect to said base 22. Said connecting rod 51 has a first cavity 511 and a second cavity 515, which said opening and closing pin 44 is capable of engaging with.

Figure 8:
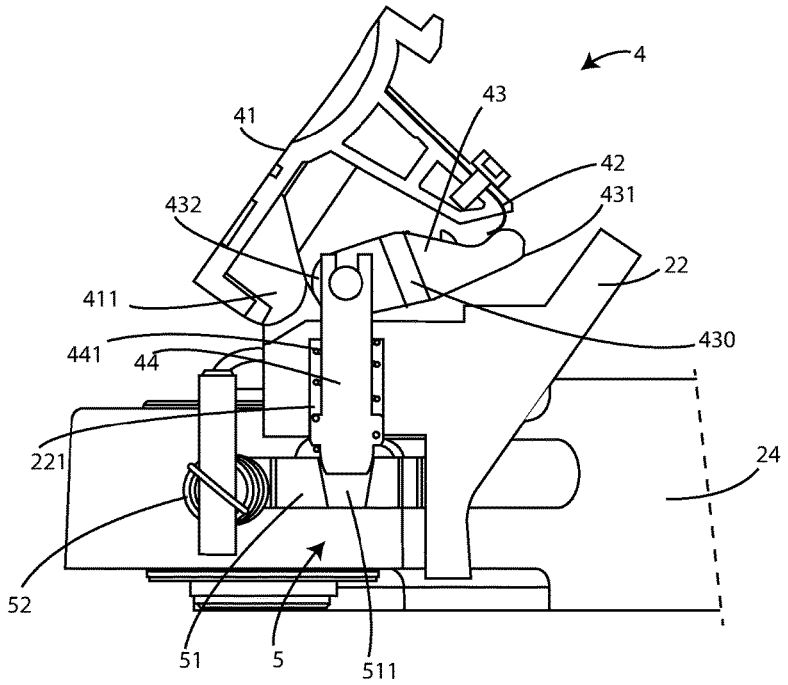
FIG. 8 shows a side view of the opening and closing system according to FIG. 7 in the closing position of the support frame.
Figure 9:
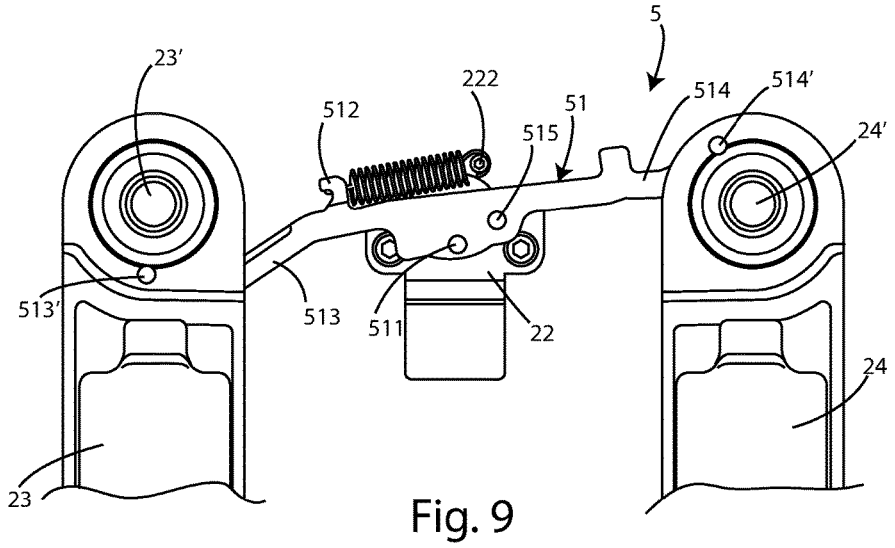
FIG. 9 shows a plan view of the opening and closing system of the support frame according to the present invention in the closed position of the support frame.
Figure 12:
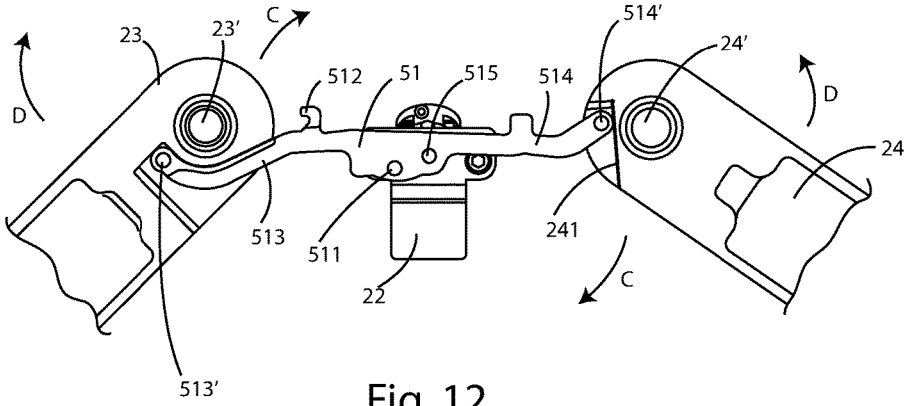
FIG. 12 shows a plan view of the opening and closing system of the support frame in the open position of the support frame.
Figure 13:
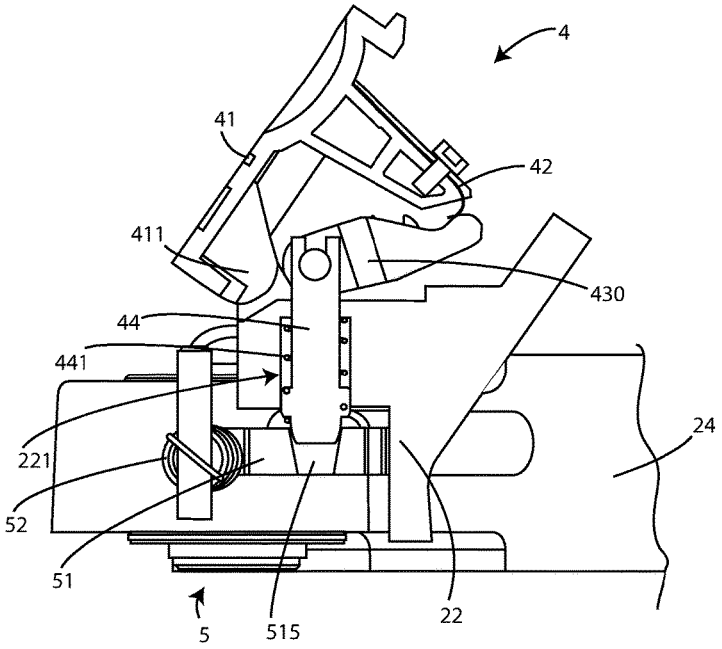
FIG. 13 shows a side view of the opening and closing system in the closed position of the support frame.

In particular, referring to FIGS. 8 and 9, in the closing position of said frame 2, said opening and closing pin 44 is inserted into said first cavity 511. Referring to FIGS. 12 and 13, in the opening position of said frame 2, said opening and closing pin 44 is inserted into said second cavity 515. The actuation unit 5 also comprises an opening spring 52, arranged and hooked to said hook 512 and said anchoring pin 222 of said base 22 or of said frame 2 in general, to accompany the opening of said frame 2.

The operation of the cycling simulation device 1 described above is as follows.

Figure 10:
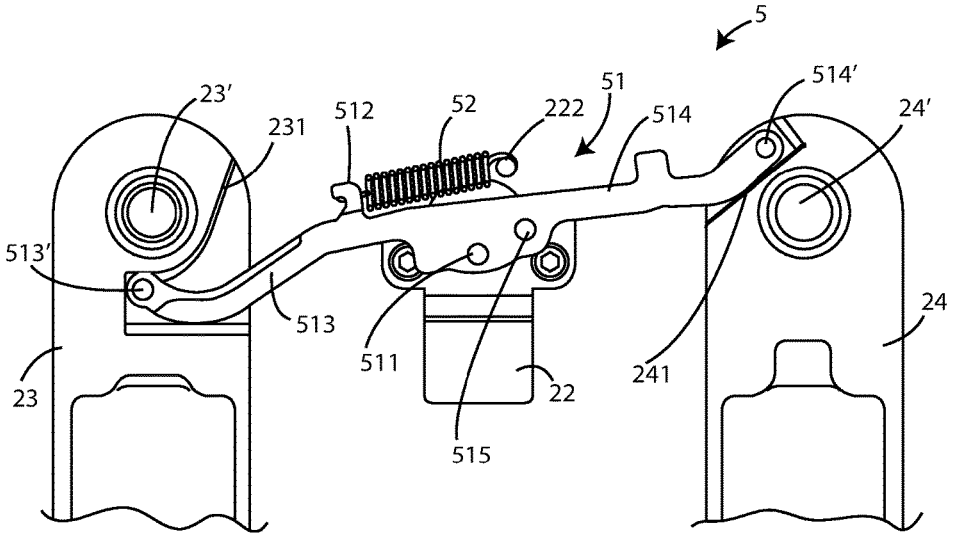
FIG. 10 shows a plan view of the opening system according to FIG. 9.

Referring to FIGS. 8-10, when the cycling simulation device 1 is in the closed position, the opening and closing pin 44 is in said working position, i.e. lowered, interfering with said first cavity 511 of said connecting rod 51 and it is kept in this working position by the action of the contrast spring 441.

At the same time, the opening spring 52 is extended and preloaded, as shown in FIG. 9, and said first 23 and second 24 arm are substantially parallel, as shown in FIG. 3 or 4.

Figure 11:
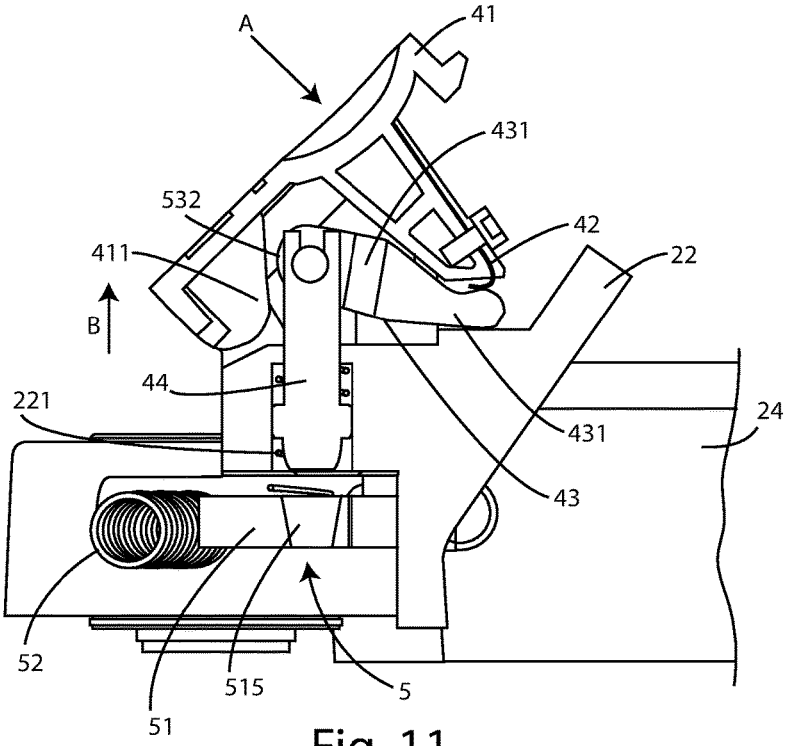
FIG. 11 shows a side view of the opening and closing system in a transition position between the closed position of the support frame and the open position thereof.

To open the cycling simulation device 1, referring to FIGS. 11 and 12, the user presses the button 41 by exerting a force in the direction of the arrow A, so as to exert a stress on the first end 431 of the lever 43 by means of said plate 42, which compensates for any mechanical play between said button 41 and said lever 43.

Said plate 42 is not required to produce the stress of said first end 431 but it is exclusively for the adjustment of construction tolerances.

After pressing said button 41, the user also opens one of said first 23 or second 24 arm, by moving it externally with respect to said central member 21 or said base 22.

As said lever 43 has the fulcrum in the center by means of said pin 430, said second end 432 lifts, winning the force opposed by said contrast spring 441, thereby lifting the release pin 44, which moves in the direction of the arrow B, so as to assume said retracted position, disengaging from said first cavity 511.

With the disengagement of said opening and closing pin 44 from said first cavity 511 and the moving by a user of one of the arms 23 or 24 by opening it with respect to the base, said connecting rod 51 rotates and translates according to the arrows indicated by the letter C.

Consequently, the remaining arm, being pivoted about both the base 22 and the connecting rod 51, is subjected to a stress and rotates, with respect to said connecting rod 51 and to said base, according to arrow D, i.e. moving apart, so that said support frame 2 of said cycling simulation device 1 can assume the open position.

Said first 23 and second 24 arm open until said opening and closing pin 44 engages with said second cavity 515 (see FIGS. 12 and 13), sliding on the surface of said connecting rod 51, which separates said first cavity 511 from said second cavity 515. At the same time, said first actuator arm 513 reaches said stop surface 231 and said second actuator arm 514 reaches said second stop surface 241. Once opened, the user can use the cycling simulation device in a conventional way, i.e. disassembling the rear wheel of his bicycle, engaging the traction members, i.e. the chain, with the sprocket set 31 and performing the desired exercises.

To close the support frame 2 of said cycling simulation device 1, it is sufficient that the user presses again said button 41 and manually locks one of said first 23 or second 24 arm. In this way, said connecting rod 51 rotates in the opposite direction with respect to the arrows C and said opening and closing pin 44, after its disengagement from said second cavity 515, it engages again with the first cavity 511 of said connecting rod 51 by the action of the contrast spring 441. The second end 432 of the lever 43 lifts, while the first end 431 of the same lever 43 lifts, returning the button 41 back to the original position.

In a preferred embodiment, the length of the actuator arms 513 and 514 of the rod 51 and the shape of the stop surfaces 231 and 232, respectively of said first 23 and second 24 arms, are such as to allow a slightly larger opening than the arm 23, corresponding to the side on which the sprocket set 31 is arranged, to allow a greater stability of the cycling simulation device 1 during the user's pedaling.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A support frame configured to accept a cycling simulation device, comprising:

a base, and a first arm hinged with said base and a second arm hinged with said base, so that said first and second arms are adapted to assume a closed position and an open position, rotating with respect to said base, wherein said support frame comprises an articulation member articulated with said base and said first and second arms such that rotation of one of said first or second arms relatively to said base causes a rotational translation of said articulation member and rotation of the other arm of the first and second arms with respect to said base, causing the passage from said closed position to said open position or vice versa.

2. The support frame according to claim 1, wherein the support frame comprises an opening and closing unit interacting with said articulation member, so as to lock said articulation member in position when said first and second arms assume said closing and opening positions.

3. The support frame according to claim 2, wherein said opening and closing unit comprises a button, a lever, pivoted on said base by means of a respective pin, having a first end, on which said button interacts, and a second end, an opening and closing pin, pivoted to said second end of said lever, said opening and closing pin configured to assume a working position and a rest position, and a contrast spring arranged so as to exert a force to hold said opening and closing pin in said working position, wherein said articulation member has a first cavity and a second cavity, with which said opening and closing pin is inserted or interferes when said articulation member is in said working position, respectively in said closed and open position of said first and second arms.

4. The support frame according to claim 3, wherein said base has a seat, said opening and closing pin is slidably movable in said seat, and said contrast spring is interposed between said seat and said opening and closing pin.

5. The support frame according to any claim 4, wherein the support frame comprises an elastic element, arranged between said button and said first end of said lever, said elastic element being adapted to compensate for mechanical backlashes.

6. The support frame according to claim 5, wherein said elastic element is a spring or a plate made of harmonic steel.

7. The support frame according to any claim 3, wherein the support frame comprises an elastic element, arranged between said button and said first end of said lever, said elastic element being adapted to compensate for mechanical backlashes.

8. The support frame according to claim 7, wherein said elastic element is a spring or a plate made of harmonic steel.

9. The support frame according to claim 1, wherein said articulation member is a connecting rod.

10. The support frame according to claim 9, wherein said connecting rod has a first actuator arm, pivoted to said first arm, and a second actuator arm, pivoted to said second arm.

11. The support frame according to claim 10, wherein said connecting rod comprises a hook, and wherein the support frame comprises an opening spring, hooked to said hook and said support frame or to said base or to an anchoring pin of said base, said opening spring accumulating potential energy when said support frame is in the closed position, and releasing said potential energy to facilitate the rotational translation of said connecting rod.

12. The support frame according to claim 9, wherein said connecting rod comprises a hook, and wherein the support frame comprises an opening spring, hooked to said hook and said support frame or to said base or to an anchoring pin of said base, said opening spring accumulating potential energy when said support frame is in the closed position, and releasing said potential energy to facilitate the rotational translation of said connecting rod.

13. The support frame according to claim 1, wherein said first and said second arms have a respective end stop surface, said first and second arm open until said first actuator arm and said second actuator arm of said articulation member arrive in proximity respectively of said end stop surface of said first arm and said end stop surface of said second arm.

14. The support frame according to claim 1, wherein said articulation member, said base and said first and second arms are articulated so as to allow the greater opening of one of said first and second arms relative to each other.

15. The support frame according to claim 1, wherein the support frame comprises a main support member integral with said base, on which a mechanical unit of the cycling simulation device is installed.

16. A cycling simulation device, comprising the support frame according to claim 1, and a mechanical unit for execution or simulation of gymnastic exercise, the mechanical unit installed on said support frame and comprising a sprocket set keyed on a shaft, a pulley keyed on said shaft, a flywheel connected by transmission members to said pulley, and braking members acting on said flywheel.

17. The support frame according to claim 16, wherein the transmission members connecting the flywheel to said pulley is a belt.

* * * * *